US007617847B1

(12) United States Patent
Clerkin

(10) Patent No.: US 7,617,847 B1
(45) Date of Patent: Nov. 17, 2009

(54) APPARATUS AND METHOD FOR FORMING WIRE

(76) Inventor: Thomas M. Clerkin, 6787 Cornelius Rd., Syracuse, IN (US) 46567

( * ) Notice: Subject to any disclaimer, the term of this patent is extended or adjusted under 35 U.S.C. 154(b) by 0 days.

(21) Appl. No.: 11/947,338

(22) Filed: Nov. 29, 2007

Related U.S. Application Data

(60) Provisional application No. 60/872,088, filed on Dec. 1, 2006.

(51) Int. Cl.
*B21F 7/00* (2006.01)
*B21F 11/00* (2006.01)

(52) U.S. Cl. ..... 140/149; 140/139; 72/129

(58) Field of Classification Search ..... 140/30, 140/36, 45, 139, 149, 117–120; 72/129, 72/203

See application file for complete search history.

(56) References Cited

U.S. PATENT DOCUMENTS

| | | | |
|---|---|---|---|
| 300,741 | A | 6/1884 | Spruce |
| 2,250,610 | A | 7/1941 | Simons |
| 2,286,759 | A | 6/1942 | Patnode |
| 3,158,258 | A | 11/1964 | Kelday et al. |
| 3,713,323 | A | 1/1973 | Ivanier |
| 3,786,623 | A | 1/1974 | Eliason |
| 3,811,311 | A | 5/1974 | Barone et al. |
| 3,955,390 | A | 5/1976 | Geary |
| 3,961,514 | A | 6/1976 | Geary |
| 4,300,378 | A | 11/1981 | Thiruvarudchelvan |
| 5,151,147 | A | 9/1992 | Foster et al. |
| 5,830,583 | A | 11/1998 | Clouser et al. |
| 6,871,523 | B2 | 3/2005 | Ishizuka et al. |
| 6,886,385 | B2 | 5/2005 | Lottner |
| 7,269,987 | B2 | 9/2007 | Ollis |
| 2004/0187539 | A1 | 9/2004 | Ishizuka et al. |

FOREIGN PATENT DOCUMENTS

| | | | |
|---|---|---|---|
| JP | 362021416 | A | 1/1987 |
| JP | 401304721 | A | 12/1989 |
| JP | 405141409 | A | 6/1993 |

*Primary Examiner*—Dana Ross
*Assistant Examiner*—Teresa M Bonk
(74) *Attorney, Agent, or Firm*—Barnes & Thornburg LLP

(57) ABSTRACT

An apparatus and method for forming a single strand wire with improved flexibility and a stranded cable from a single strand wire. In one embodiment, the flexible single strand wire has a solid, single strand wire body and at least one helical groove formed on an outer circumferential surface of the wire body. The stranded cable includes a plurality of strands. In one embodiment, one of the strands has a planar surface that extends along a longitudinal axis of the cable body.

7 Claims, 11 Drawing Sheets

APPARATUS AND METHOD FOR FORMING WIRE

RELATED APPLICATIONS

The present application is related to and claims priority to U.S. Provisional Patent Application Ser. No. 60/872,088, filed on Dec. 1, 2006, entitled "Apparatus and Method for Forming Wire." The subject matter disclosed in that provisional application is hereby expressly incorporated by reference into the present application.

TECHNICAL FIELD

The present invention relates to improved types of wire and particularly to an apparatus and method for forming wire.

BACKGROUND AND SUMMARY

Wire is often used to electrically couple various components. A number of factors affect the electrical and physical characteristics of wire. The greater the current carrying capacity required, the more metal needed, such as copper, steel, silver, gold, aluminum, brass, nickel, copper clad steel, stainless steel, or any alloys and platings thereof. Conversely, the more metal in the wire, the stiffer and less flexible the resultant single strand wire. The less flexible the wire, the greater the work hardening of the metal due to bending and the lower the flex life (i.e., service life).

To overcome this hurdle, cable designers often replace a large gage single strand wire with a multitude of smaller strands, twisted into a flexible cable. The resultant product carries the same electrical current but is easier to manipulate and has the added benefit of a longer flex life.

There are tradeoffs, however, between improved flexibility and other physical properties. For example, the stranded wire will have a serrated exterior surface. Since the wire is formed from a plurality of strands twisted together, the exterior surface does not have a continuous round surface as that of a single strand wire. This is due to the gaps (also known as interstices) between the single ends in the twisted cable. To meet the minimum insulation thickness required by the end user, and to create the necessary round shape of coated wire, more insulation must be injected into the gaps between the strands of wire on the exterior of the wire. This results in a net waste of insulation materials. Thicker insulation also serves to reduce the flexibility of the end product.

Wire made of multiple strands also has a lower elongation, and a lower yield strength than a single strand of wire with equivalent cross sectional area. This means that stranded wire pulls apart at a lower tensile force than an equivalently sized solid wire. The interstices between the strands inside a cable provide a conduit that allows moisture to wick up a cable and into electronics located at the end of the cable, which may cause corrosion.

The improved flexibility of the multiple strand wire comes at a steep price. The greatest cost of manufacturing wire typically occurs in two areas: (1) drawing the larger single strand wire down to the smaller multiple strands; and (2) twisting the multiple strands back up into cable. Current technology requires a significant investment in the purchase, installation and operation of large, capital intensive equipment. Due to the separate manufacturing operations, there are substantial productivity costs. For example, whether stranding or bunching, existing devices require the wire to be twisted as a separate manufacturing operation. Existing devices are also physically incapable of drawing multiple strands of wire, twisting them and coating them in one operation.

There are other downsides to multiple strand wire. For example, existing devices take up substantial floor space. Existing drawing devices are large, bulky and require specialized ancillary processing equipment. Since current twisting device's line speed is 10% of the other processes it therefore needs ten-fold the amount of floor space.

The existing process requires the manufacture and storage of large amounts of Work In Process ("WIP") materials. Single strands must be stored in containers; stranded uncoated cable must also be stored in a container. The cost of WIP can be expressed in value added material stored in an inventory location. Eliminating or reducing WIP would reduce overall time from purchase order to delivery, since no time or materials would be spent to create WIP.

When all the cable has been consumed from the WIP container, or when finished goods container has been completely filled, the process must be interrupted. This represents a huge inconvenience and loss of productivity. Because WIP containers must be changed at regular intervals, and to avoid re-stringing the entire process line, the cable ends must be joined together to form the continuous length of finished product. Existing joining devices require the use of butt welders and/or brazing techniques. This generally creates a weak point in the wire that must be removed from the finished cable. Because current technology requires wire to be stored in containers between operations, there is a quantifiable and significant expense in moving WIP between storage locations and between processes. This expense is in the form of labor and equipment to move the WIP.

Another disadvantage of stranded wires is the payoff and takeup equipment required before and after each manufacturing step in the existing process. This equipment represents a significant investment in capital equipment and are responsible for a non value added increase in complexity, maintenance and equipment costs.

Because the existing drawing, stranding and extrusion operations are completely separate and unconnected, each operation therefore has discrete and unconnected manpower requirements. Wire drawing process requires perishable tooling to form and control wire outer diameter ("OD"). The smaller the diameter of the single strands, the greater number of perishable tools required. Large multi-wire drawing machines also require matched-diameter die sets of perishable tooling which comes as an added expense. Moreover, the sheer size of current technology requires an enormous operating expense.

According to one aspect, the invention provides a single strand wire with improved flexibility. The wire may be formed by a process including the steps of providing a source of single strand wire defining a longitudinal axis. The process may include the step of twisting the single strand wire in a first direction about the longitudinal axis. A longitudinal groove may be formed in the single strand wire. The wire may then be reshaped into a substantially round cross-section. The process may include the step of twisting the single strand wire in a second direction about the longitudinal axis, forming a helical groove in the outer circumferential surface of the wire body to improve flexibility.

In another aspect, the invention provides a flexible, single strand wire, which may include a solid, single strand wire body. A helical groove may be formed on an outer circumferential surface of the wire body to improve flexibility.

According to another aspect, the invention provides a stranded cable, which includes a cable body with a plurality of ductile metal strands. Typically, the strands are severed from the same single strand wire.

In yet another aspect, the invention provides a stranded cable formed by a process that includes the step of providing a source of single strand wire defining a longitudinal axis. The single strand wire is twisted in a first direction about the longitudinal axis and severed along the longitudinal axis to form a stranded cable with at least two strands. This stranded cable is then twisted in a second direction about the longitudinal axis.

Additional features and advantages of the invention will become apparent to those skilled in the art upon consideration of the following detailed description of the illustrated embodiment exemplifying the best mode of carrying out the invention as presently perceived.

BRIEF DESCRIPTION OF DRAWINGS

The present disclosure will be described hereafter with reference to the attached drawings which are given as non-limiting examples only, in which.

DETAILED DESCRIPTION OF THE DRAWINGS

Figure 1:
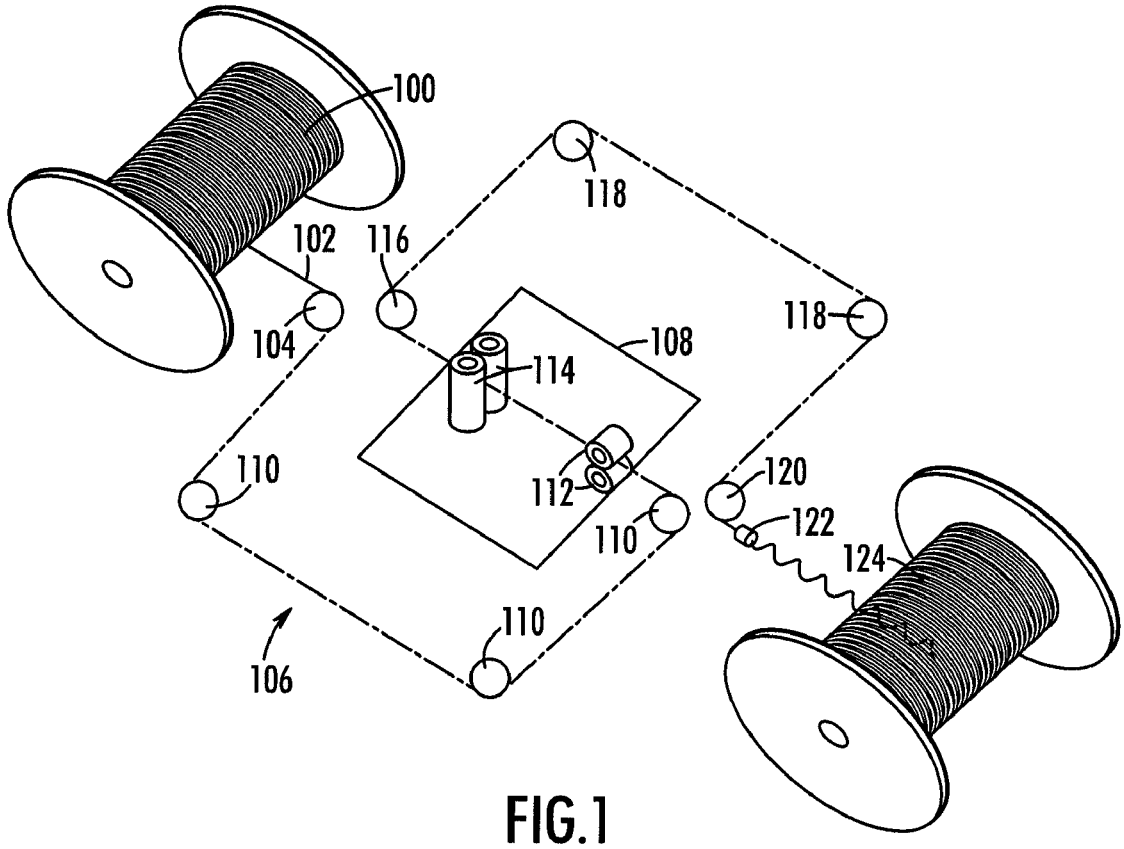
FIG. 1 is a diagrammatical representation of an apparatus for forming a flexible single strand wire according to an embodiment of the invention.
Figure 2:
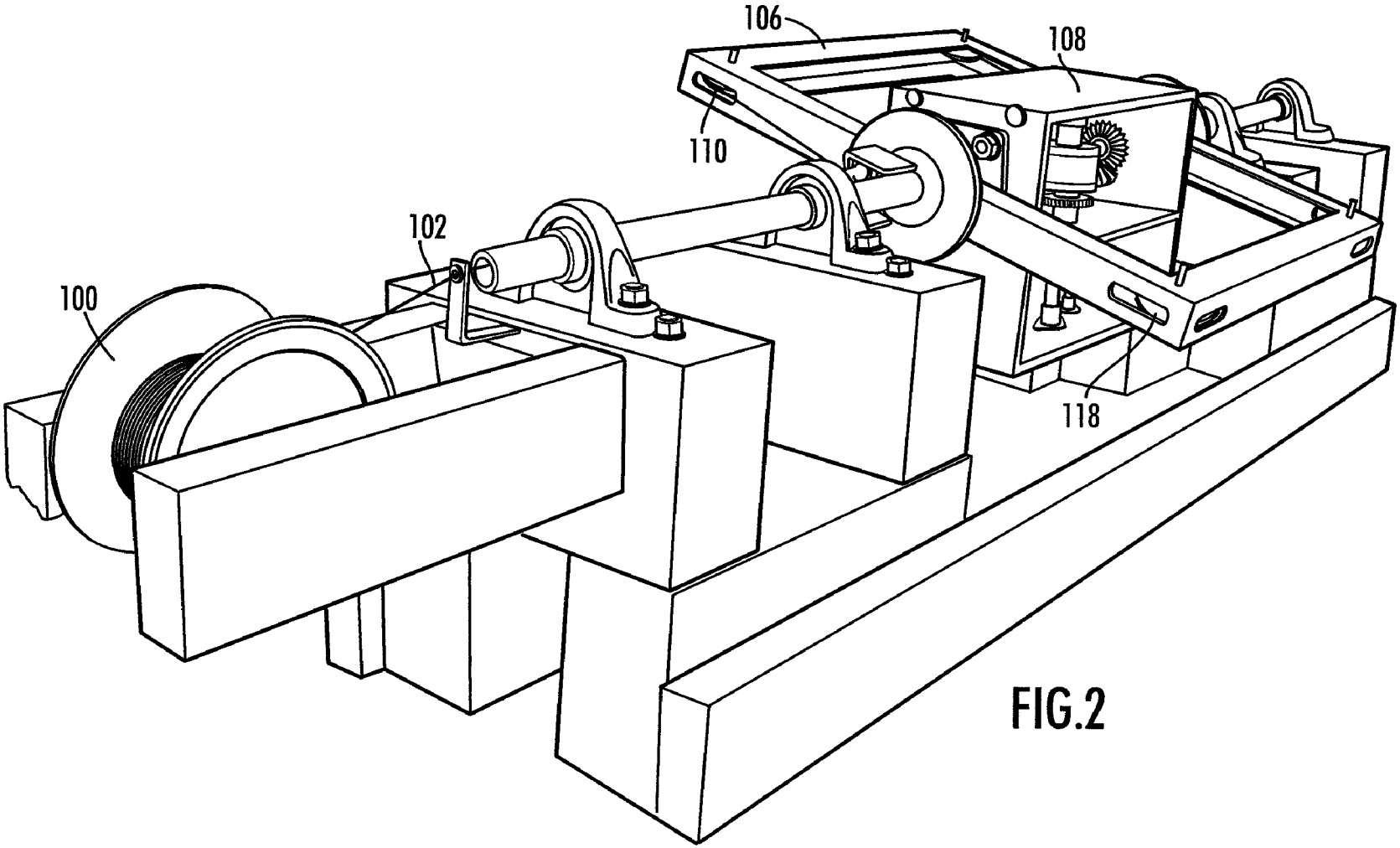
FIG. 2 is a perspective view of an example apparatus for forming wire according to the embodiment shown in FIG. 1.
Figure 3:
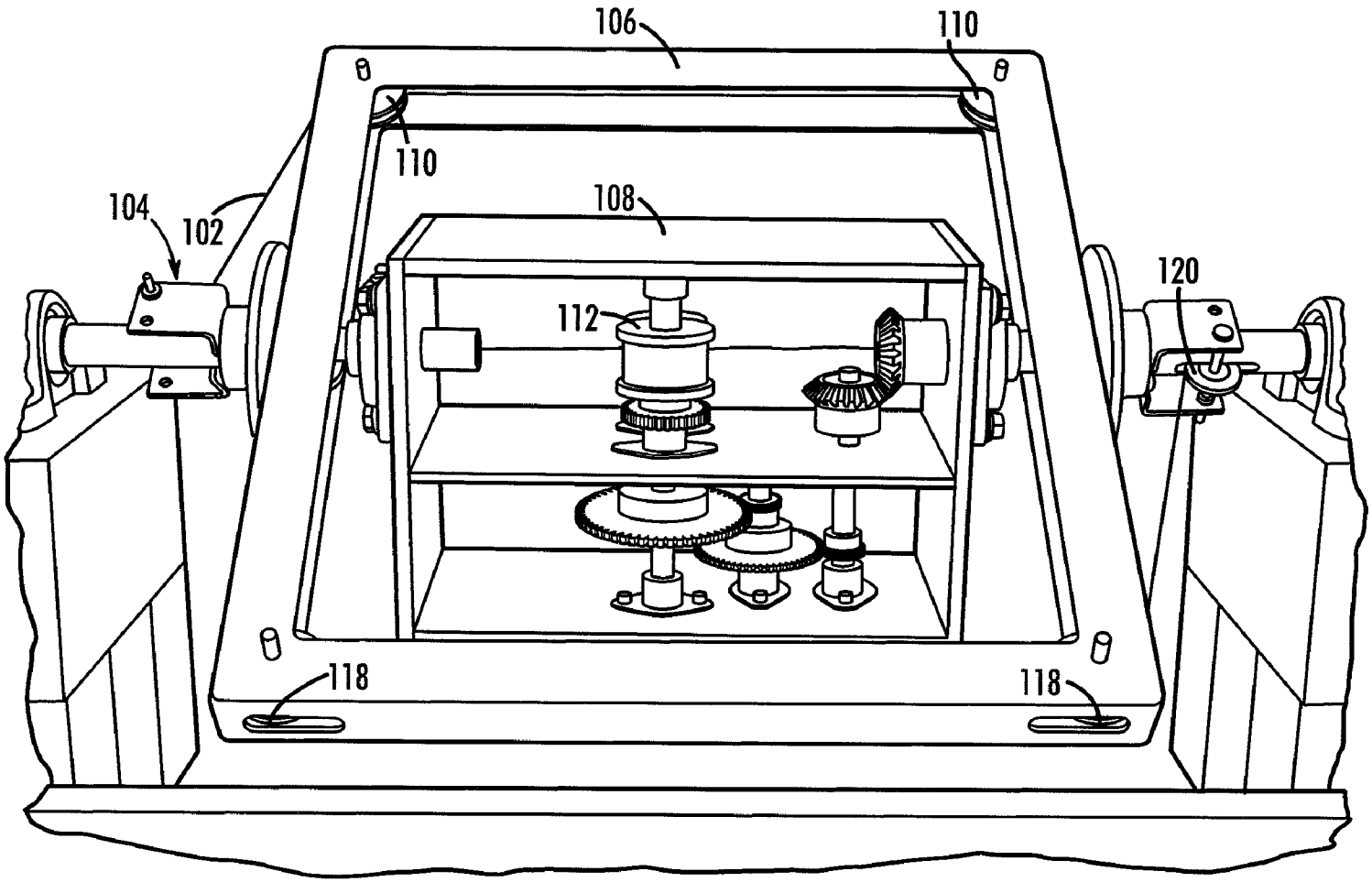
FIG. 3 is a detailed perspective view of the rotating flyer and stationary cradle from the embodiment shown in FIG. 2.

FIGS. 1-3 show an example apparatus for forming flexible single strand wire according to an example embodiment of the invention. In this embodiment, a stationary payoff source 100 supplies a continuous single strand wire 102 to a rotating flyer 106 using a guide pulley 104. Embodiments are contemplated in which the payoff source 100 could be replaced by another source of single strand wire 102, including such as a drawing machine. In some cases, the single strand wire 102 may be a ductile metal, including but not limited to copper, steel, silver, gold, aluminum, brass, nickel, copper clad steel, stainless steel and any alloys and/or platings thereof. In some embodiments, the single strand wire 102 need not necessarily be a metal. Although the term "wire" is intended to include electrical wire, it also encompasses wires used to carry mechanical loads. The single strand wire 102 may be a variety of different sizes, including but not limited to, 10 AWG to 26 AWG. As shown, additional guide pulleys 110 direct the wire 102 into a stationary cradle 108, which may include a pair of driven abutting form rollers 112 and a pair of abutting closing rollers 114. The orientation of the rollers 112, 114 are shown in FIG. 1 for illustrative purposes only; the rollers 112, 114 could have other orientations.

While the wire 102 is in the cradle 108, the driven form rollers 112 create a continuous longitudinal groove in the wire 102. This continuous longitudinal groove is not meant to sever the wire 102; instead the groove would form two (or more) conjoined segments of the wire 102. Although the embodiment shown uses form rollers 112 to form the longitudinal groove, a variety of other devices could be used to form the groove, including but not limited to dies, lasers, knives, etc. The shape and size of the groove may vary depending upon the desired output wire. In some cases, multiple longitudinal grooves may be formed in the single strand wire 102, which could be formed at once or sequentially. Embodiments are contemplated in which a processing bath, which could include wet or dry lubricants, could be provided to aid in forming the longitudinal groove. In some cases, the form rollers 112 could be driven with gears and/or pulleys or other mechanisms.

The wire 102 then travels through the closing rollers 114, which applies a compressive force, thereby reforming the wire 102, such as into a round cross section. Embodiments are contemplated in which the closing rollers 114 could be a variety of dies or other mechanisms for reshaping the wire 102. Upon leaving the cradle 108, the wire 102 is once again drawn by a guide pulley 116 into the rotating flyer 106 back around the cradle 108 via guide pulleys 118 where the wire 102 exits the rotating flyer 106 via a guide pulley 120. The wire 102 then travels through an optional closing die 122 and onto a stationary takeup 124. In some cases, the takeup 124 could be replaced by the next operation in the manufacturing process, such as an annealer or a wire coating extruder.

Rotating the wire 102 around the form rollers 112 and around the closing rollers 114 in relation to the stationary payoff source 100 and the stationary takeup 124, creates a resulting continuous helical groove in the resulting wire. By rotating the wire in this manner, it imparts an internal twist within the incoming single strand wire and imparts an opposite external twist to the flexible single strand wire exiting the rotating flyer 106. The opposite external twist also acts to relieve the internal stresses created by the internal twist in the incoming single strand wire 102. It should be appreciated by one skilled in the art that the number of twists per inch could vary depending on the desired characteristics of the outgoing wire.

Figure 4:
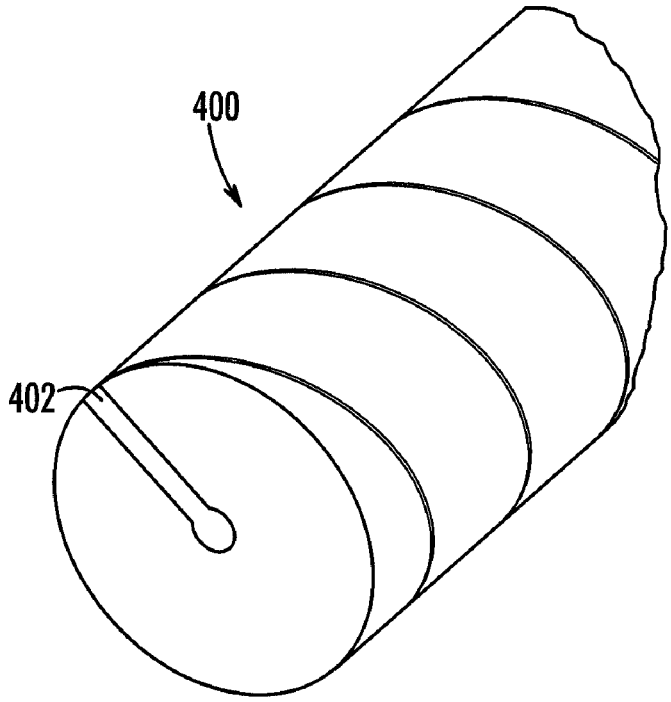
FIG. 4 is a perspective view of flexible single strand wire portion according to one embodiment.
Figure 5:
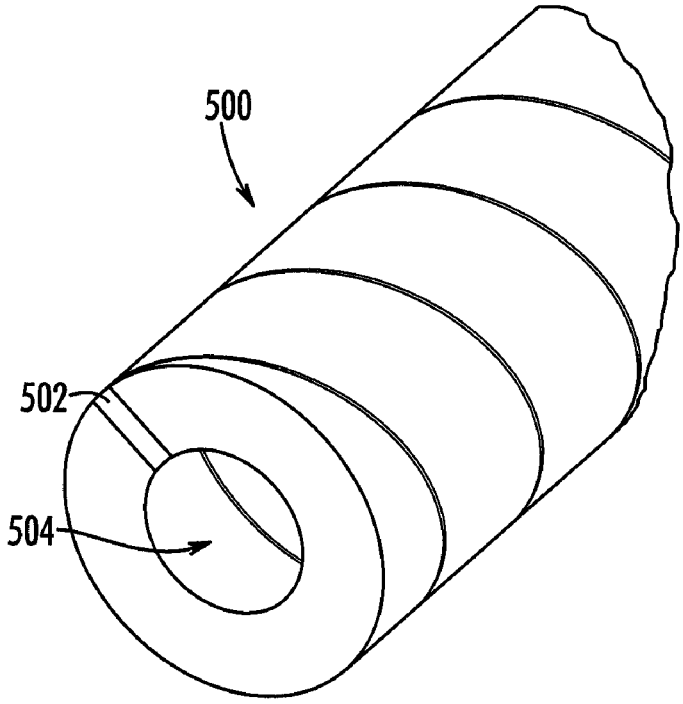
FIG. 5 is a perspective view of flexible single strand wire portion according to an alternative embodiment.

FIGS. 4 and 5 show example wire portions that could be formed using the apparatus of FIGS. 1-3. In FIG. 4, the wire portion 400 includes a continuous helical groove 402, which increases the flexibility of the wire compared to the original single strand wire, prior to forming the groove 402. In this example, the groove 402 has a depth of approximately the radius of the wire 400. Embodiments are contemplated in which a groove could be deeper or shallower than the groove 400 shown in FIG. 4. FIG. 5 shows an example wire portion 500 in which the incoming wire was hollow. In this example, a continuously longitudinal groove 502 extends upon the entire wire portion 500. Due to the hollow nature of the incoming single strand wire, the wire portion 500 includes a passageway 504 therethrough.

Figure 6:
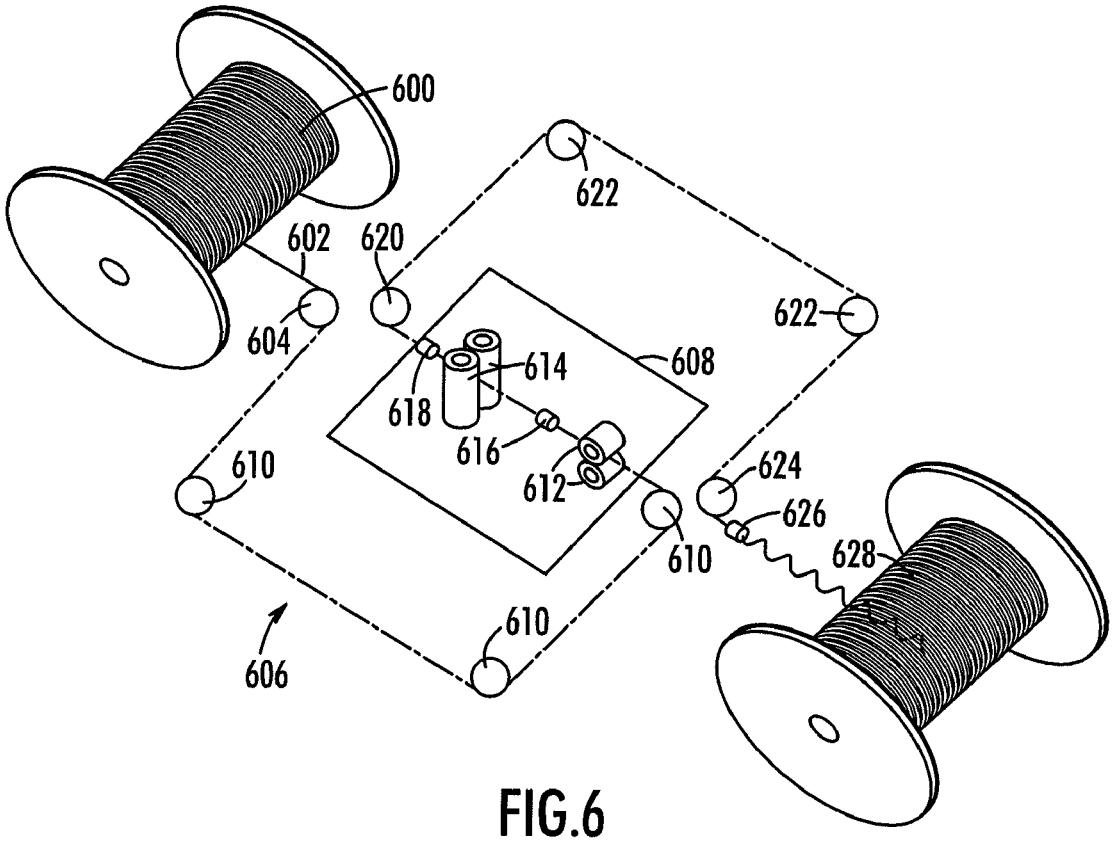
FIG. 6 is a diagrammatical representation of an apparatus for forming stranded cable according to an embodiment of the invention.
Figure 7:
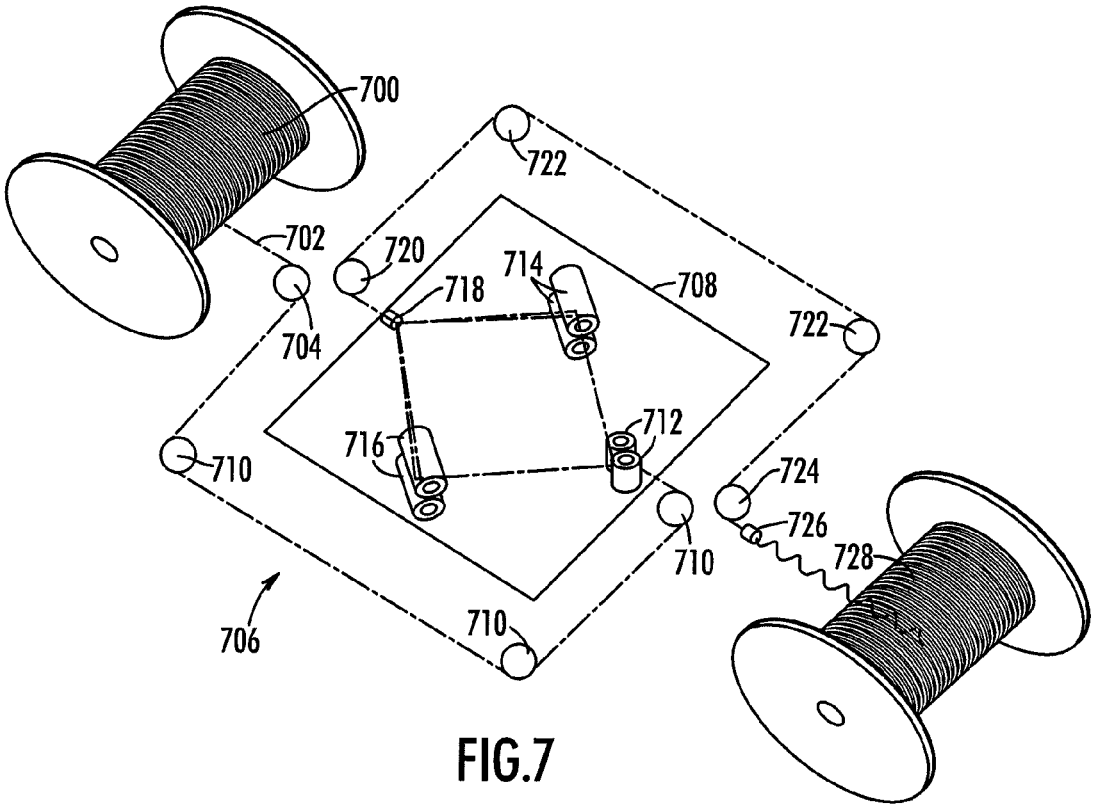
FIG. 7 is a diagrammatical representation of an apparatus for forming stranded cable according to an alternative embodiment of the invention.
Figure 8:
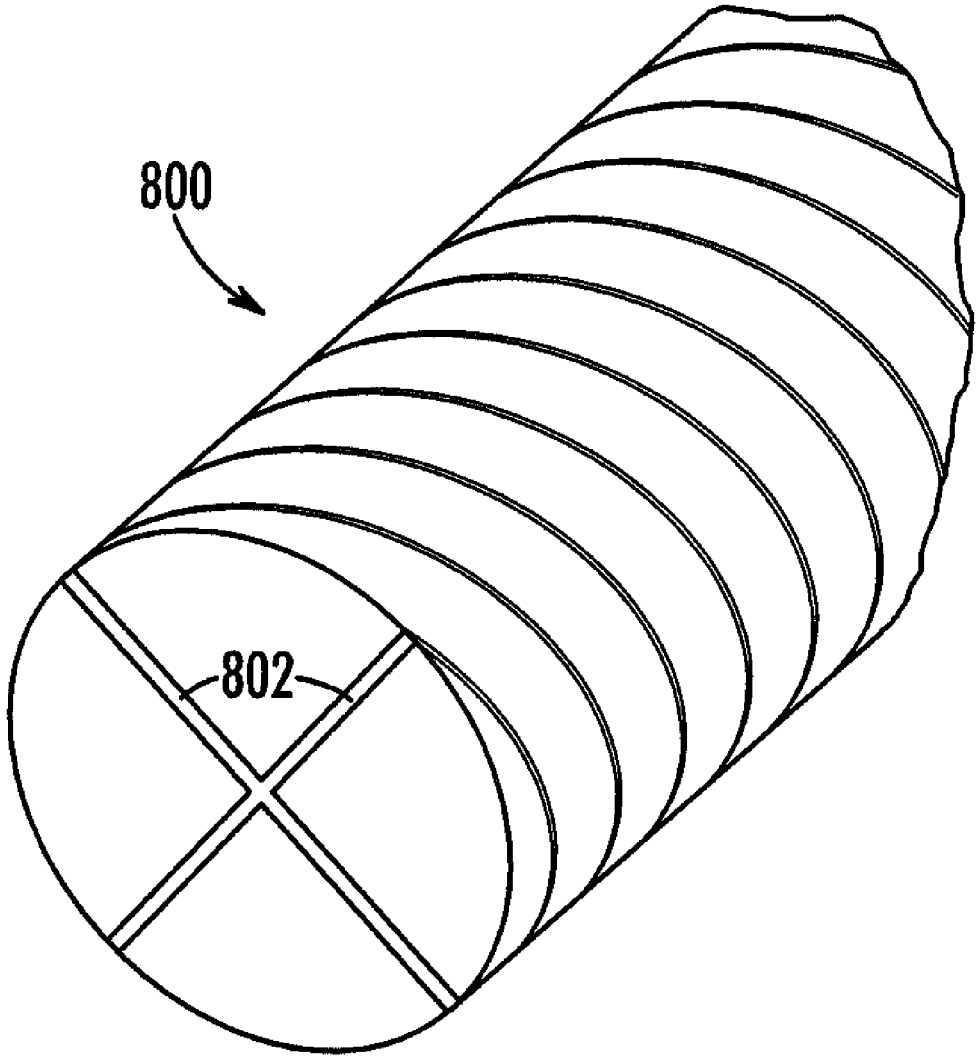
FIG. 8 is a perspective view of a stranded cable portion formed using either of the apparatuses shown in FIG. 6 or 7.
Figure 9:
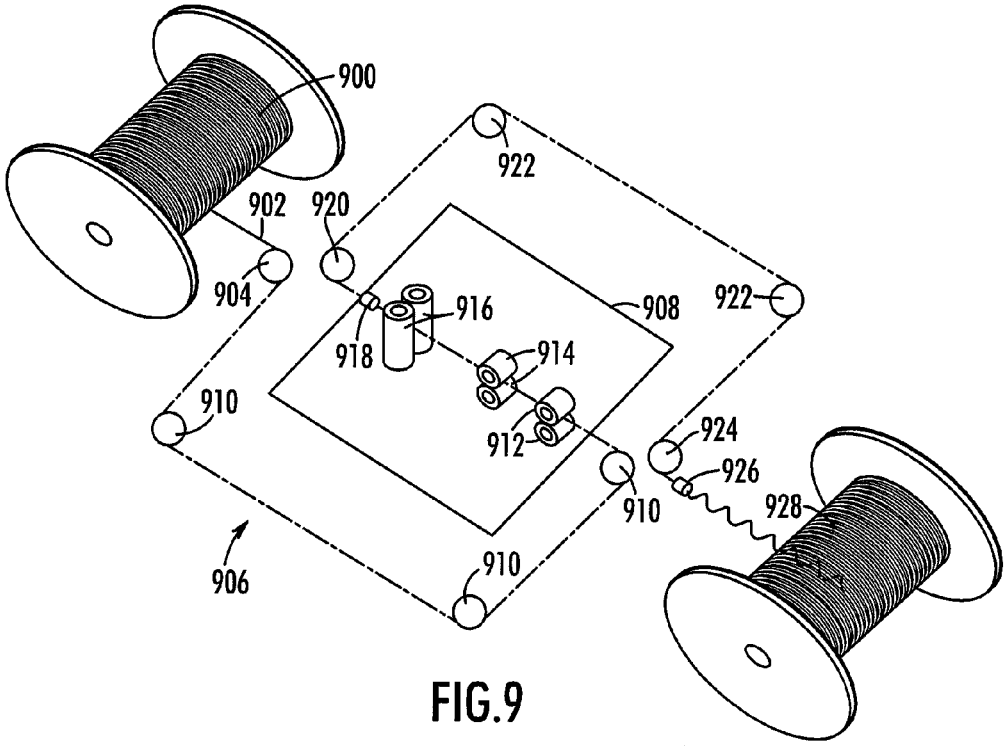
FIG. 9 is a diagrammatic representation of an apparatus for forming stranded cable according to another embodiment of the invention.
Figure 10:
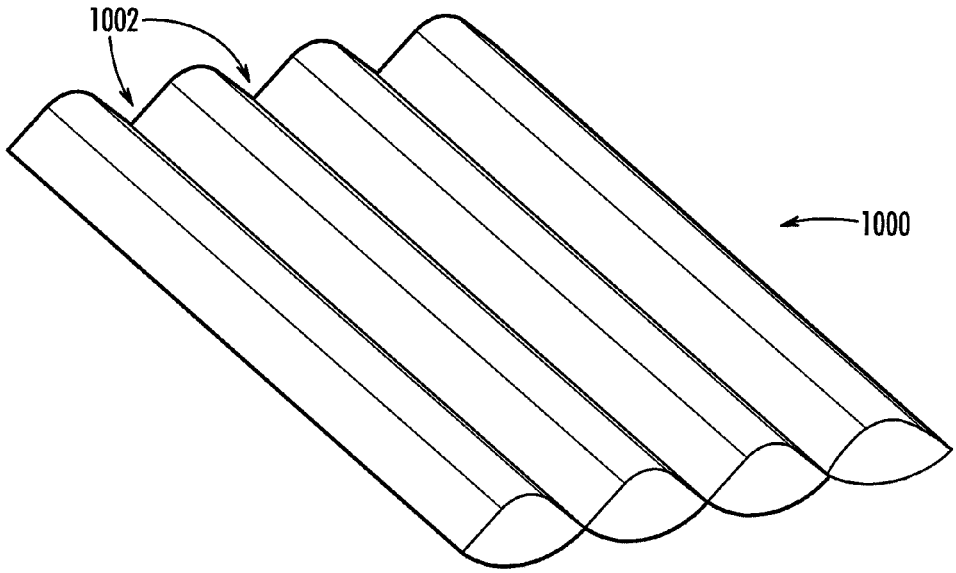
FIG. 10 is a perspective view of a wire portion formed in an intervening step during operation of the apparatus shown in FIG. 9.
Figure 11:
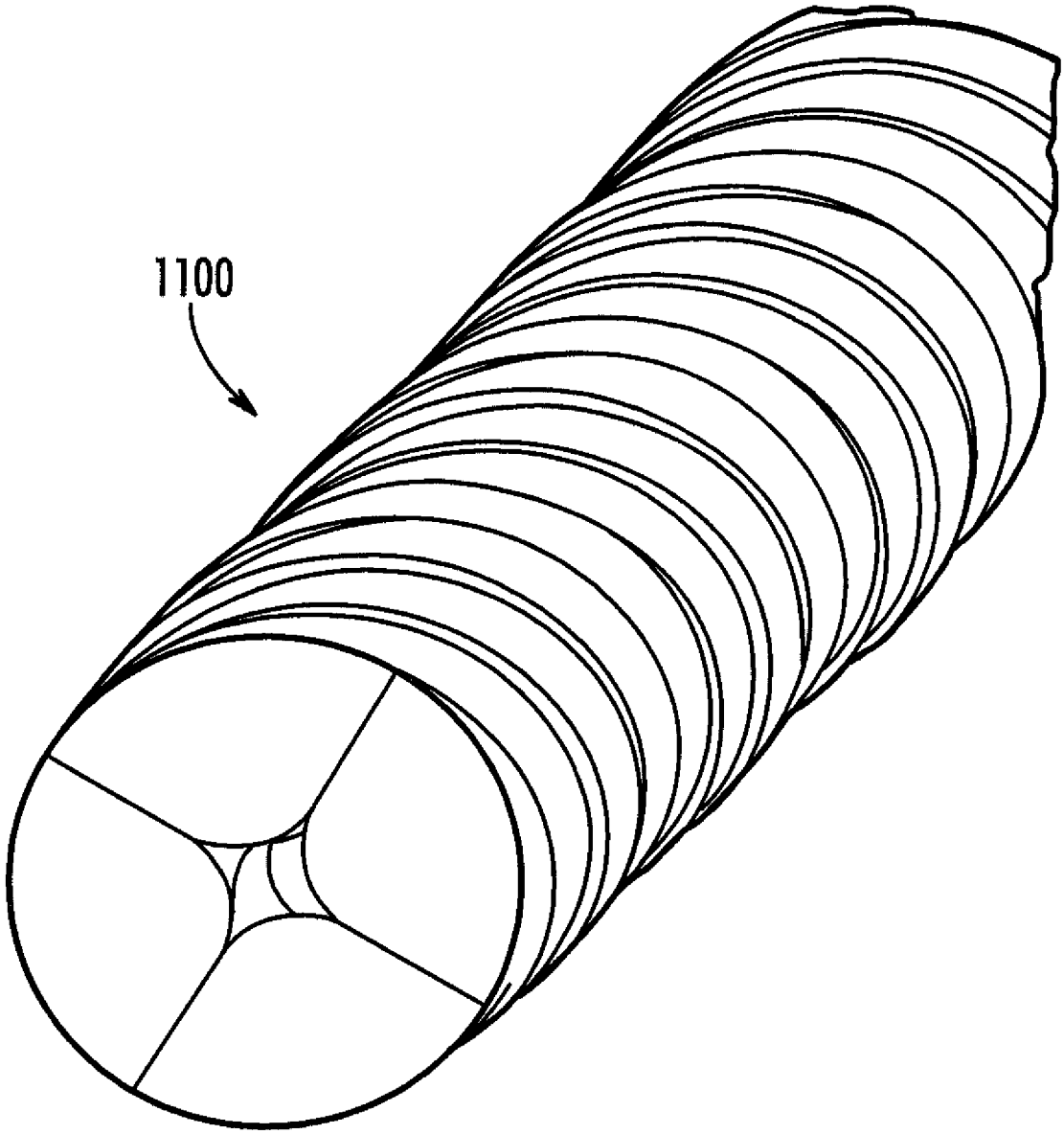
FIG. 11 is a perspective view of a stranded cable portion formed using the apparatus shown in FIG. 9.

FIGS. 6-11 show diagrammatical views of various apparatuses for forming stranded cable from single strand wire, according to a variety of embodiments. Examples of stranded cable that may result from the apparatuses are shown in FIGS. 8 and 11. As discussed below, the examples of stranded cable in FIGS. 8 and 11 include 4 strands, but could include less or more strands depending upon the particular circumstances.

In the embodiment shown in FIG. 6, a stationary payoff source 600 provides a single strand wire 602 to a rotating flyer 606 via a guide pulley 604. The wire 602 is directed around a stationary cradle 608 using additional guide pulleys 610 in this example. The cradle 608, in this embodiment, includes two pairs of driven abutting form rollers 612, 614, and two closing dies 616, 618.

While the wire 602 is in the cradle 608, the driven form rollers 612 cut the wire 602 into two continuous longitudinal segments (which would each have a semi-circular cross-section where the wire 602 has a circular cross-section). Upon being rejoined in the closing die 616, the wire 602 travels into driven form rollers 614, which cut the wire 602 in a perpendicular direction with respect to the cut from the rollers 612 in this example. Accordingly, the driven form rollers 614 cut the two-wire segment assembly into four continuous strands (which would each have a quarter round cross-section if the wire 602 has a circular cross-section). Although the wire 602 is severed into four strands in this example, it should be appreciated that the wire 602 could be divided into more or less portions. As discussed above, there are numerous other devices that could be used to cut the wire 602, which applies with equal effect to these embodiments.

Upon entering closing die 618, the strands are again rejoined into the stranded cable 800 shown in FIG. 8. In FIG. 8, the stranded cable portion 800 shows the joints 802 where the strands were severed from the single strand wire and include an arcuate portion on the periphery of the cable portion 800. Upon exiting the cradle 608, the wire 602 is drawn via a guide pulley 620 into the rotating flyer 606 back around the cradle 608 using additional guide pullies 622 in this example. As shown, the wire 602 exits the rotating flyer 606 via a guide pulley 624 and travels through an optional closing die 626 into a takeup 628.

By rotating the wire 602 around the form rollers 612, 614 and closing dies 616, 618 in relation to the wire source 600 and takeup 628, this creates a resulting continuous helical twist in the wire 602, thus forming flexible stranded cable 800. This rotation imparts an internal twist within the incoming single stranded wire and imparts an opposite external twist in the flexible stranded cable 800 exiting the cradle 608. The opposite external twist also acts to relieve internal stresses created by the internal twist in the incoming single strand source 600.

FIG. 7 is a diagrammatical view of an alternative embodiment for forming the stranded cable 800 shown in FIG. 8. In this embodiment, a payoff source 700 provides a single strand wire 702 that is drawn via a guide pulley 704 into a rotating flyer 706. The wire 702 is directed around a stationary cradle 708 by using additional guide pulleys 710. In this embodiment, the cradle 708 includes three pairs of driven abutting form rollers 712, 714, 716, and a closing die 718.

While the wire 702 is in the cradle 708, the driven form rollers 712 cut the wire 702 into two continuous longitudinal segments. Each segment travels into driven form rollers 714, 716, which cut each segment in half in this embodiment. Upon entering the closing die 718, the segments are again rejoined into a stranded cable assembly, as shown in FIG. 8. As discussed above, embodiments are contemplated with more or less than four strands.

Upon leaving the cradle 708, the wire 702 is drawn via a guide pulley 720 into the rotating flyer 706. The wire 702 is then moved back around the cradle 708 using additional guide pulleys 722, where it exits the rotating flyer 706 via a guide pulley 724. The wire 702 then travels through an optional closing die 726 and onto a takeup 728.

FIG. 9 is a diagrammatical view of an example apparatus that can be used to form the example stranded cable shown in FIG. 11. Although the example shown in FIG. 11 has four strands, it should be appreciated that more or less strands could be provided. It should be appreciated that the shape of the strands can vary depending on the application. In this embodiment, a payoff source 900 provides a single strand wire 902 that is drawn via a guide pulley 904 into a rotating flyer 906. The wire 902 is directed around a stationary cradle 908 using additional guide pulleys 910. In this embodiment, the cradle 908 includes three pairs of driven abutting form rollers 912, 914, 916 and a closing die 918.

While the wire is in the cradle 908, the driven form rollers 912, 914 will form the wire 902 into one continuous length of shaped strands held together by a thin web between the strands, such as shown in FIG. 10. The wire 902 travels immediately into driven form rollers 916, which roll up the relatively flat wire to a round form, an example of which is shown in FIG. 11. The wire 902 then enters the closing die 918.

Upon leaving the cradle 908, the wire 902 is drawn using a guide pulley 920 into the rotating flyer 906. The wire 902 is then brought back around the cradle 908 using additional guide pulleys 922, and exits the rotating flyer 906 via a guide pulley 924. The wire 902 then travels through a closing die 926 and onto the takeup 928.

Figure 12:
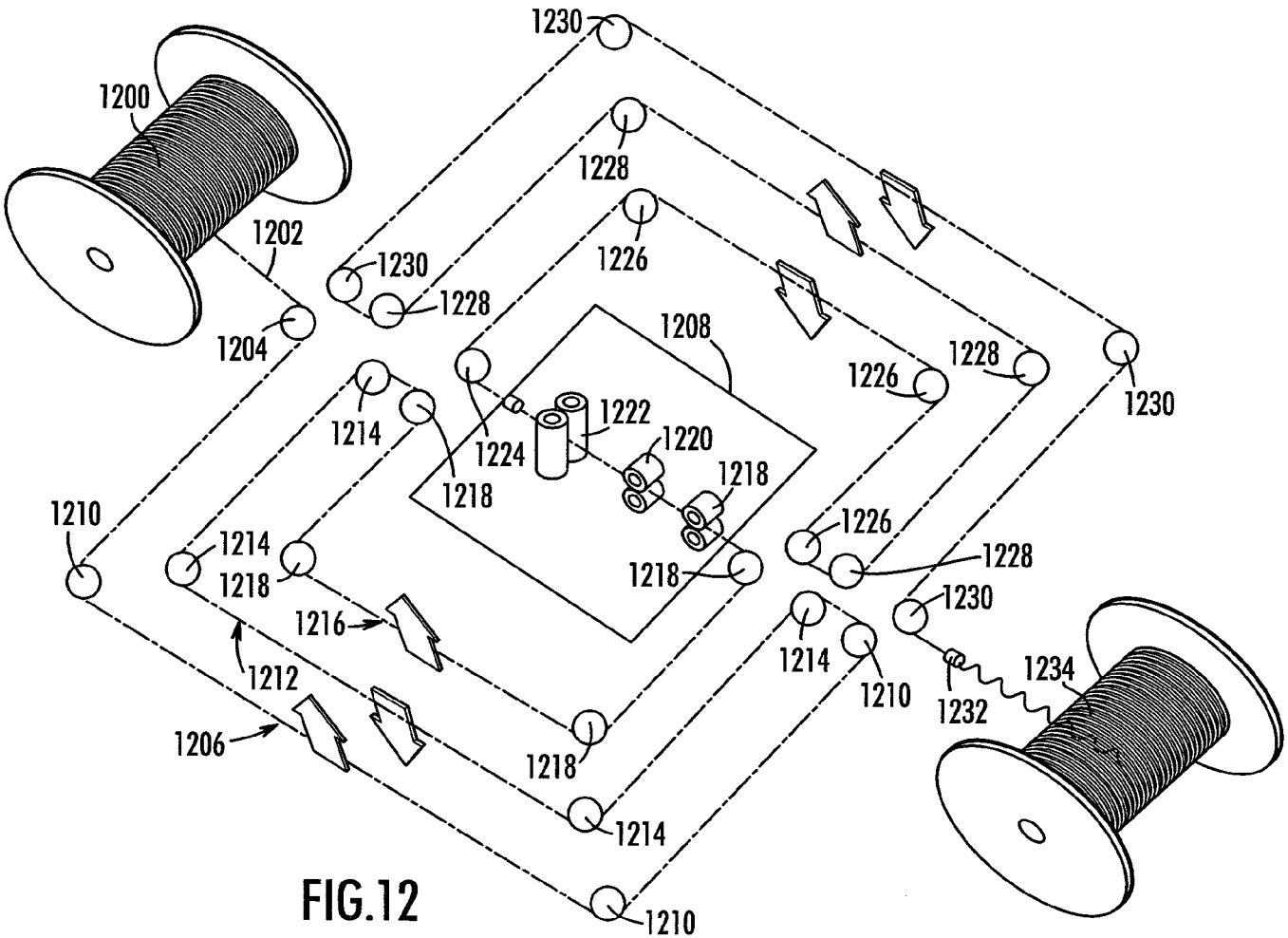
FIG. 12 is diagrammatical representation of an apparatus for applying blocking compound either flexible single strand wire or stranded cable according to an embodiment of the invention.

FIG. 12 is a diagrammatical view of an apparatus that uses multiple rotating flyers to increase line speed. This type of arrangement could be used to form either the flexible single strand wire or the stranded cable discussed herein. In this example, a payoff source 1200 provides a wire 1202 that is drawn via a guide pulley 1204 onto a first rotating flyer 1206. The wire 1202 is directed around a stationary cradle 1208 using additional guide pulleys 1210. The wire 1202 then travels to a second rotating flyer 1212, which is rotating in the opposite direction as the first rotating flyer 1206. Additional guide pulleys 1214 direct the wire 1202 around the cradle 1208 and onto a third flyer 1216. In this example, the third flyer 1216 is rotating in the same direction as the first rotating flyer 1206, but in the opposite direction of the second rotating flyer 1212. The wire 1202 travels using additional guide pulleys 1218 to enter the cradle 1208. Although this example shows three rotating flyers 1206, 1212, 1216, the number of rotating flyers is not limited.

While the wire is in the cradle 1208, an arrangement of form rollers 1218, 1220, and dies 1222 create a continuous length of wire as described in previous embodiments. In other words, the cradle 1208 could be arranged to form flexible single strand wire or stranded cable, including the examples shown in FIG. 4, FIG. 5, FIG. 8, or FIG. 11.

Upon leaving the cradle 1208, the wire 1202 is drawn via a guide pulley 1224 onto the third rotating flyer 1216. The wire 1202 travels back around the cradle 1208 using guide pulleys 1226. The wire is then provided to the second rotating flyer 1212 via guide pulleys 1228 and then the first rotating flyer 1206 via guide pulleys 1230. The wire 1202 then leaves a first rotating flyer 1206 through an optional closing die 1232 and is placed onto a takeup 1234.

Figure 13:
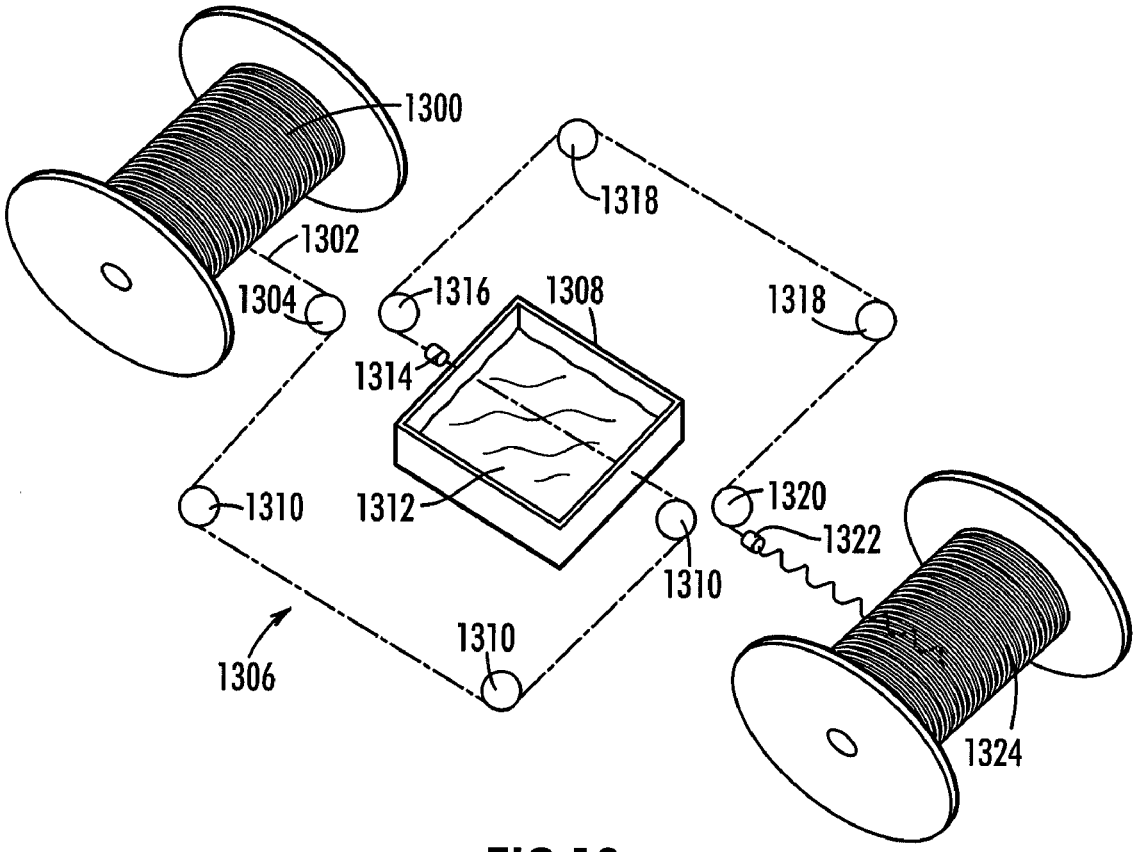
FIG. 13 is a diagrammatical representation of an apparatus for forming either flexible single strand wire or stranded cable according to an embodiment of the invention.

FIG. 13 is a diagrammatical view of an example apparatus for forming wire according to another embodiment in which a blocking compound is provided. This is applicable to both flexible single strand wire and stranded cable as discussed herein. In this embodiment, a payoff source 1300 provides a form stranded or flexible single strand wire 1302 which is drawn via a guide pulley 1304 into a rotating flyer 1306. The wires are directed around a stationary cradle 1308 using additional guide pulleys 1310. Once the wire 1302 is in the cradle 1308, the wire 1302 is placed in a blocking compound 1312 and then through a closing die 1314

While the wire 1302 is in the cradle 1308, the blocking compound 1312 enters the open gaps in the wire for the entire continuous length of the longitudinal groove. Upon entering the closing die 1314, the wire 1302 is again closed up into a final wire assembly.

Upon leaving the cradle 1308, the wire 1302 is drawn via guide pulley 1316 into the rotating flyer 1306. The wire 1302 then moves back around the cradle 1308 using additional guide pulleys 1318 where it exits the rotating flyer 1306 via a guide pulley 1320. The wire 1302 then travels through an optional closing die 1322 and onto the takeup 1324. By rotating the wire around the stationary cradle 1308, it opens up the helical groove or strands coming into the cradle 1308 and imparts an opposite external twist in the flexible stranded wire coming out of the cradle 1308. The opposite external twist also acts to trap the blocking compound inside the helical grooves and interstices in the flexible single strand or stranded wire.

Although the present disclosure has been described with reference to particular means, materials and embodiments, from the foregoing description, one skilled in the art can easily ascertain the essential characteristics of the present disclosure and various changes and modifications may be made to adapt the various uses and characteristics without departing from the spirit and scope of the present invention as set forth in the following claims.

What is claimed is:

1. A stranded cable formed by a process comprising the steps of:

(a) providing a source of generally cylindrical single strand wire defining a longitudinal axis;

(b) twisting the single strand wire in a first direction about the longitudinal axis;

(c) severing the generally cylindrical single strand wire along the longitudinal axis to form at least two severed strands, wherein the severed strands include a planar portion and an arcuate portion;

(d) joining the severed strands together such that the arcuate portion of the severed strands define a substantially continuous and uninterrupted circumferential surface, wherein a planar portion of a severed strand is adjacent a planar portion of another severed strand when the severed strands are joined together to minimize gaps between the joined strands; and (e) twisting the joined strands in a second direction about the longitudinal axis to form a stranded cable.

2. The stranded cable formed by the process as recited in claim 1, wherein each strand includes a planar surface along the longitudinal axis.

3. The stranded cable formed by the process as recited in claim 1, further comprising severing each of the strands along the longitudinal axis.

4. The stranded cable formed by the process as recited in claim 1, wherein the single strand wire is a ductile metal.

5. The stranded cable formed by the process as recited in claim 1, wherein the stranded cable includes at least four strands and each strand includes planar portions joined at a vertex and the arcuate portion is opposite the vertex.

6. The stranded cable formed by the process as recited in claim 5, wherein the planar portions are angled with respect to each other by approximately 90 degrees or less.

7. The stranded cable formed by the process as recited in claim 5, wherein the vertexes of strands are adjacent at least one vertex of another strand when the strands are joined in step (d).

* * * * *